US008854159B2

(12) United States Patent
Sheta et al.

(10) Patent No.: US 8,854,159 B2
(45) Date of Patent: Oct. 7, 2014

(54) TRIPLE-MODE MICROSTRIP FILTER

(75) Inventors: Abdel F. A. Sheta, Riyadh (SA); Majeed A. R. Alkanhal, Riyadh (SA); Saleh A. Alshebeili, Riyadh (SA); Mohamed A. M. Abouelela, Cairo (EG)

(73) Assignee: King Saud University, Riyadh (SA)

( * ) Notice: Subject to any disclaimer, the term of this patent is extended or adjusted under 35 U.S.C. 154(b) by 722 days.

(21) Appl. No.: 13/052,100

(22) Filed: Mar. 20, 2011

(65) Prior Publication Data

US 2012/0235772 A1 Sep. 20, 2012

(51) Int. Cl.
*H01P 1/203* (2006.01)
*H01P 7/08* (2006.01)

(52) U.S. Cl.
CPC ..... *H01P 1/203* (2013.01); *H01P 7/082* (2013.01); *H01P 1/20381* (2013.01)
USPC ..... 333/204; 333/219

(58) Field of Classification Search
CPC ..... H01P 1/203; H01P 7/082; H01P 7/088; H01P 1/20381
USPC ..... 333/204, 205, 219, 235
See application file for complete search history.

(56) References Cited

U.S. PATENT DOCUMENTS 5,315,753 A * 5/1994 Jensen et al. ..... 29/600
6,700,459 B2 * 3/2004 Raihn et al. ..... 333/99 S
2005/0190018 A1 * 9/2005 Kawai et al. ..... 333/235

OTHER PUBLICATIONS

Coccioli et al., "Aperture-Coupled Patch Antenna on UC-PBG Sbustrate", Nov. 1999, IEEE, vol. 47, pp. 2123-2130.*
Robertson et al.; RFIC and MMIC Design Technology; 2001; The Institution of Engineering and Technology, London, United Kingdom; First edition, p. 451-452.*

* cited by examiner

*Primary Examiner* — Benny Lee
*Assistant Examiner* — Gerald Stevens
(74) *Attorney, Agent, or Firm* — Lowe Hauptman & Ham, LLP

(57) ABSTRACT

Microstrip filters and methods of operation are described. In one aspect, a filter includes a substrate having a substantially planar surface and a microstrip patch located on the surface of the substrate. The microstrip patch includes multiple symmetric slots in the microstrip patch, a first feed line extending from the microstrip patch, and a second feed line extending from the microstrip patch. The first and second feed lines are asymmetric.

6 Claims, 11 Drawing Sheets

TRIPLE-MODE MICROSTRIP FILTER

BACKGROUND

Microstrip filters are used in many applications, such as communication systems and radar systems. Specific applications include RF (radio frequency) and microwave transmitters and receivers, satellite communication systems, communication relays and various measurement systems. Microstrip filters are used to pass signals having specific frequencies with minimum insertion loss while rejecting other signals outside the specified frequencies.

The growing use of mobile devices and wireless communication systems has increased the demand for communication components, including microstrip filters. Existing microstrip filters typically include resonators that have specific resonance frequencies. To perform certain filter characteristics (e.g., filter performance) using single mode resonators, multiple resonators are necessary. Thus, in systems requiring high order filters, the use of multiple single mode resonators increases the complexity of the design as well as the space occupied by the multiple resonator filters.

SUMMARY

The described systems and methods relate to triple-mode microstrip filters and the operation thereof. A specific filter includes a substrate with a substantially planar surface. A microstrip patch is located on the surface of the substrate. The microstrip patch includes multiple substantially symmetric slots, a first feed line extending outwardly from the microstrip patch, and a second feed line extending outwardly from the microstrip patch. The first and second feed lines are asymmetric.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In the Figures, the left-most digit of a component reference number identifies the particular Figure in which the component first appears.

The Figures discussed herein are not necessarily drawn to scale. Some dimensions may be changed to better illustrate specific details or relationships.

DETAILED DESCRIPTION

Overview

The microstrip filter described herein includes a microstrip patch resonator that is capable of operating in three different modes. By providing multiple modes of operation, this single resonator microstrip filter is able to perform the function of a filter based on three separate single-mode resonators.

The microstrip patch resonator includes a substantially square conductive patch with four rectangular slots—one in each of the four sides of the square. Two conductive stubs and two conductive feed lines extend from the square patch at various locations. The square patch is located on one surface of a substrate, and a conductive ground layer is located on an opposite surface of the substrate. A conductive shorting post located in the center of the square patch connects the square patch to the conductive ground layer on the opposite side of the substrate.

Particular microstrip filters discussed herein show various configurations, sizes, and locations of the slots, stubs and feed lines. However, the present invention is capable of implementation in a variety of different configurations with substrates, slots, stubs and feed lines of different shape, different size and different location on different dielectric materials (e.g., substrates).

The filters described herein are useful in a variety of applications, such as RF (radio frequency) and microwave communication systems as well as RF and microwave synthesizer modules contained in instruments and wireless communication devices. Specific applications include satellite communications, wireless base stations, radars, microwave relays and electronic measurement systems.

An Exemplary Microstrip Filter

Figure 1:
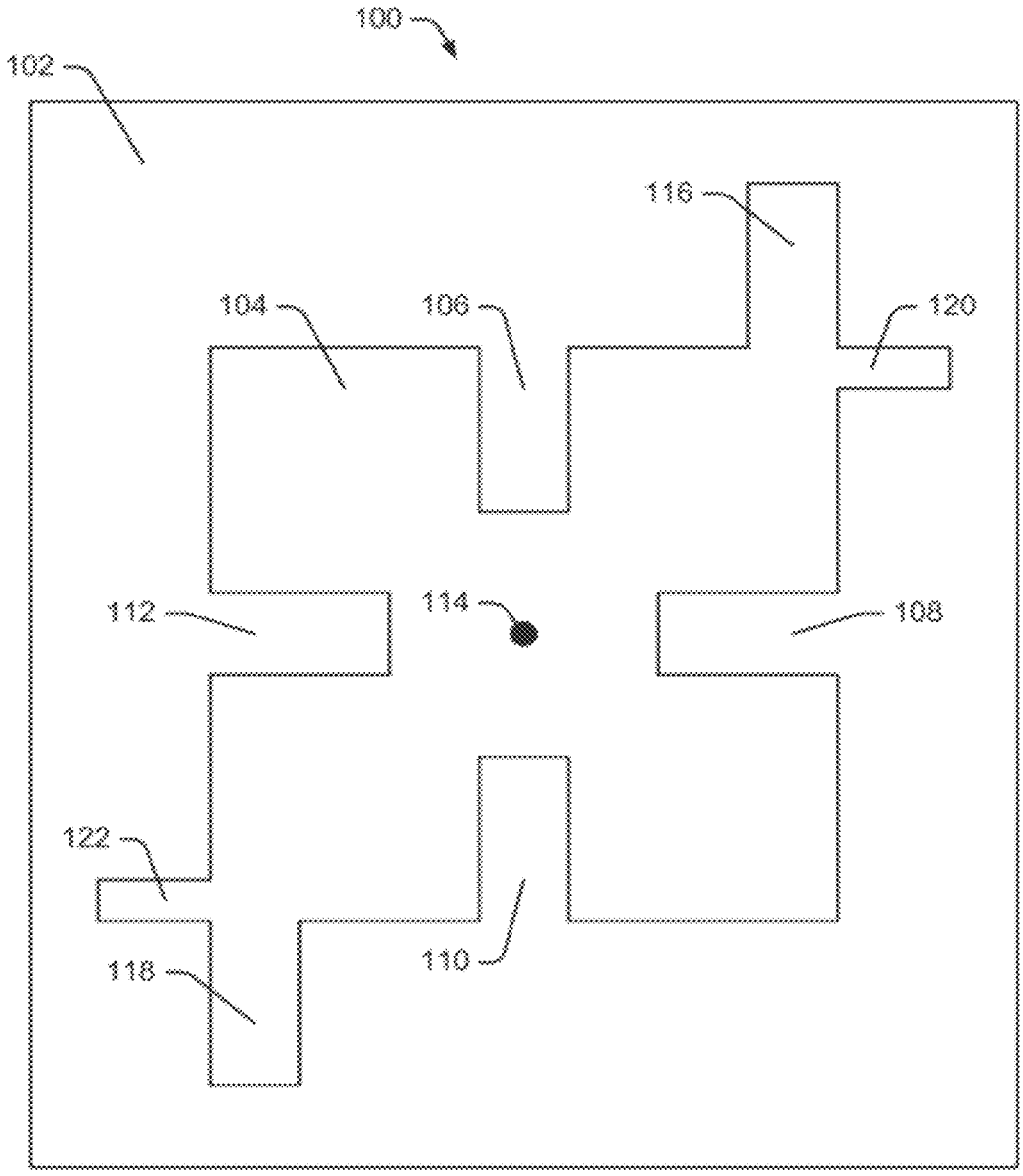
FIG. 1 shows an exemplary triple-mode microstrip filter, according to one embodiment.

FIG. 1 shows an exemplary triple-mode microstrip filter 100, according to one embodiment. Filter 100 includes a conductive microstrip patch 104 disposed on a surface of a substrate 102. As discussed below, the opposite side of substrate 102 has a conductive ground layer disposed thereon. In a particular embodiment, substrate 102 is a Duroid® substrate with a dielectric constant of approximately 102 and a thickness of approximately 0.78 mm (millimeters). Duroid® substrates are manufactured by Rogers Corporation of Rogers, Conn. In one embodiment, microstrip patch 104 is a thin conducting layer having a thickness of approximately 20 μm (micrometers).

Microstrip patch 104 has a substantially square shape and includes four rectangular slots 106, 108, 110 and 112. As shown in FIG. 1, each of the four rectangular slots 106-112 extends inward from one of the four sides of microstrip patch 104. In the embodiment of FIG. 1, rectangular slots 106-112 are arranged in a symmetric manner and are substantially the same size. In alternate embodiments, rectangular slots 106-112 are positioned in different arrangements and have different sizes.

Microstrip patch 104 also includes a conductive shorting post 114 located in the center of the microstrip patch. Shorting post 114 provides an electrically conductive path between microstrip patch 104 and the conductive ground layer on the opposite side of substrate 102. Two conductive stubs 116 and 118 extend outwardly from microstrip patch 104. In the embodiment of FIG. 1, stubs 116 and 118 are substantially the same size and shape. In alternate embodiments, stubs 116 and 118 may have different shapes and/or different sizes. Stubs 116 and 118 are located at opposite diagonal corners of microstrip patch 104. As discussed below, stubs 116 and 118 may extend outwardly from different positions on microstrip patch 104 and in different directions.

Two asymmetric feed lines 120 and 122 extend outwardly from microstrip patch 104. In a particular embodiment, feed lines 120 and 122 are conductive, using the same conductive material as microstrip patch 104. Feed lines 120 and 122 are referred to as "asymmetric" due to their difference in location on opposite sides of microstrip patch 104 to excite (e.g., generate) multiple modes. In the example of FIG. 1, feed lines 120 and 122 extend outwardly from microstrip patch 104 and have substantially equal sizes and shapes. In alternate embodiments, feed lines 120 and 122 may have different shapes and/or different sizes for impedance matching purposes. Feed lines 120 and 122 are located at opposite diagonal corners of microstrip patch 104, and positioned near stubs 116 and 118. As discussed below, feed lines 120 and 122 may be located in different positions on microstrip patch 104, and different positions relative to stubs 116 and 118.

In operation, input signals are applied to filter 100 via feed lines 120 and/or 122. Input signals include any type of RF/Microwave electrical signal, such as a power signal extracted from a signal generator or a synthesizer, and signals received from an antenna or radar system. Input signals may also include a weak RF/Microwave signal that has been amplified by a power amplifier as well as signals received from a mixers or similar devices. Additionally, an output signal can be received or extracted from one of the feed lines 120 or 122.

Stubs 116 and 118 are used to adjust the coupling between the multiple excited modes of the filter. In one embodiment, filter 100 functions as a triple-mode filter based on the operation of microstrip patch 104, which operates as a triple-mode resonator with three different excited modes. Operation of the triple-mode resonator is equivalent to a triple-tuned circuit. Using filter 100, the number of resonators required for a particular filter of order n is reduced to ⅓. For example, a ninth order filter (n=9) can be reduced to three resonators using the triple-mode microstrip filter discussed herein.

Filter 100 of FIG. 1 operates with three different excitation modes, which define the operating characteristics of the filter. The three excited modes are non-degenerate modes, which means the single microstrip patch 104 acts as three different coupled resonators during operation of the filter. A first operating mode is generated by the short circuit at shorting post 114. This resonator mode of filter 100 has the lowest resonant frequency (f1). This frequency (f1) is determined based on the size of microstrip patch 104 and the dimensions of slots 106-112 as well as the diameter of shorting post 114. In alternate embodiments, f1 is approximated based on the size of microstrip patch 104 and the diameter of shorting post 114, without considering the dimensions of slots 106-112. In a particular embodiment, the value of f1 is calculated using an electromagnetic simulator, such as the IE3D design and simulation software available from Mentor Graphics Corp. of Wilsonville, Oreg.

A second operating mode depends on the excitation of two degenerate modes ($TM_{100}$ and $TM_{010}$) of microstrip patch 104. The two degenerate modes do not split and maintain the same resonant frequency. The two degenerate modes are excited at a middle resonant frequency (f2). Frequency f2 is greater than frequency f1, and is determined based on the size of microstrip patch 104 and the dimensions of slots 106-112.

A third operating mode is the first higher order mode ($TM_{110}$) of microstrip patch 104. The third mode resonates at a frequency (f3), which is higher than frequencies f1 and f2. Frequency f3 is determined based on the size of microstrip patch 104 and the dimensions of slots 106-112. The procedure for calculating f3 is discussed below.

The frequencies f1, f2 and f3 associated with filter 100 decrease as the size of microstrip patch 104 increases. Also, frequencies f2 and f3 can be reduced by increasing the length of slots 106-112. The bandwidth associated with a particular filter 100 is based on the difference between frequencies f1 and f3. For example, the bandwidth of filter 100 is approximately f1 subtracted from f3. Thus, a bandwidth and a center frequency associated with filter 100 is determined by the size of microstrip patch 104 and the dimensions of slots 106-112. The procedure for determining the size of microstrip patch 104 is discussed below.

The operating characteristics of filter 100 are determined based on the dimensions of stubs 116 and 118. For example, the length of stubs 116 and 118 adjusts the coupling among the three operating modes. In a particular implementation, longer stubs 116 and 118 are used for wide-bandwidth filters.

Figure 2:
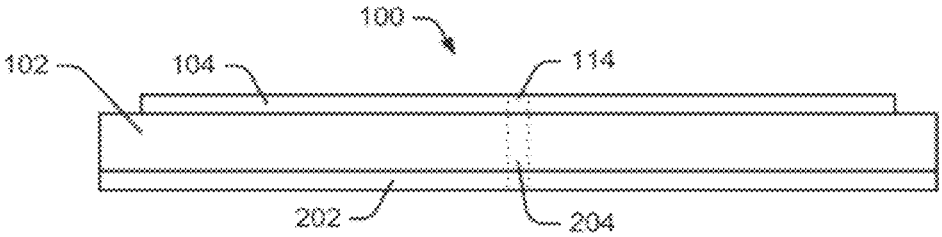
FIG. 2 illustrates a side view of the exemplary triple-mode microstrip filter shown in FIG. 1, according to one embodiment.

FIG. 2 illustrates a side view of triple-mode microstrip filter 100 shown in FIG. 1, according to one embodiment. Microstrip patch 104 is disposed on one surface of substrate 102 and a conductive ground layer 202 is disposed on the opposite surface of substrate 102. FIG. 2 also shows shorting post 114 as it extends through an aperture or other opening 204 through substrate 102. The thickness of substrate 102, microstrip patch 104 and ground layer 202 are not necessarily drawn to scale. Specific examples of the thickness of these components are discussed herein.

Figure 3:
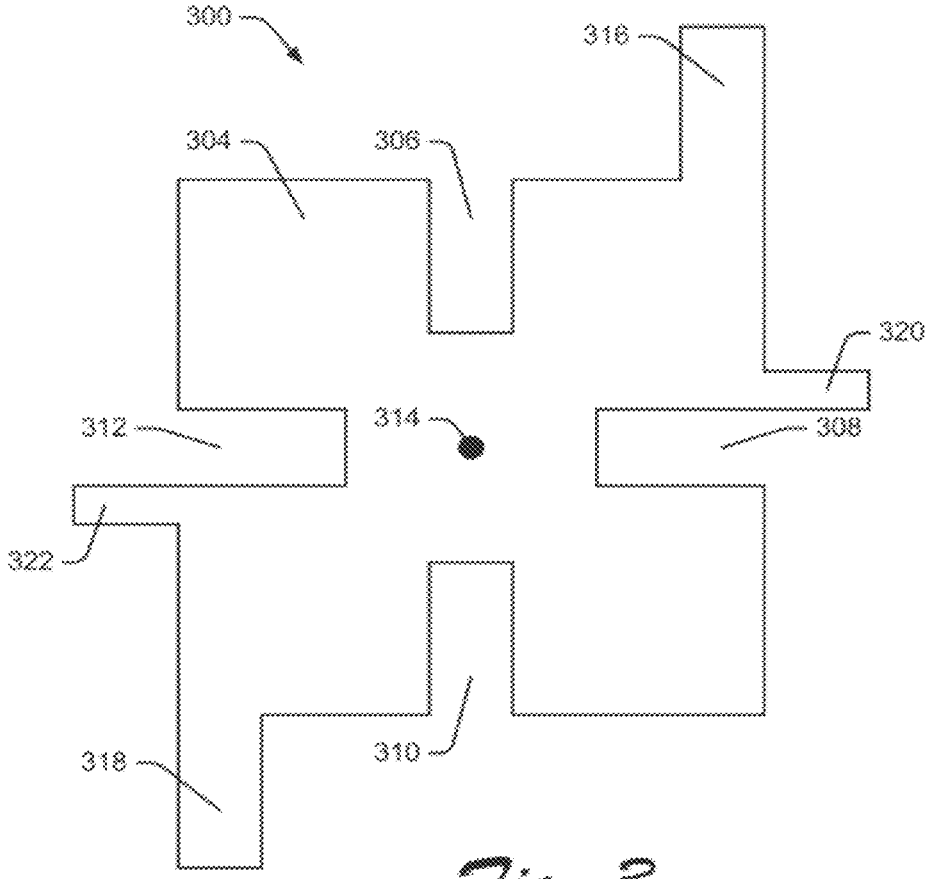
FIG. 3 shows another exemplary triple-mode microstrip filter, according to one embodiment.

FIG. 3 shows another exemplary triple-mode microstrip filter 300, according to one embodiment. Filter 300 is similar to filter 100 discussed above, but feed lines 320 and 322 are moved to a different position on a microstrip patch 304. In this example, feed lines 320 and 322 are approximately the same size as feed lines 120 and 122 shown in FIG. 1. Slots 306, 308, 310 and 312, as well as stubs 316 and 318, are substantially the same size and have the same positions as the corresponding components shown in FIG. 1. Additionally, shorting post 314 is in substantially the same position as shorting post 114 shown in FIG. 1.

Figure 4:
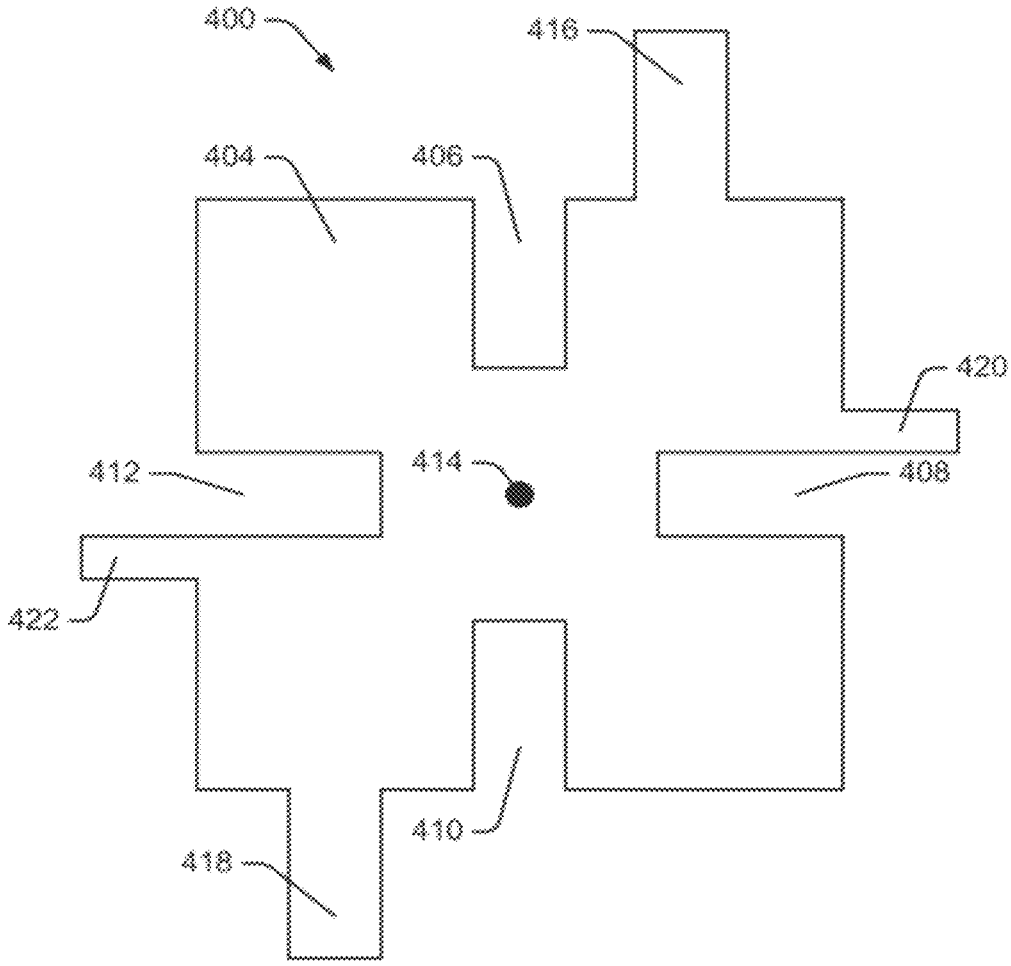
FIG. 4 shows another exemplary triple-mode microstrip filter, according to one embodiment.

FIG. 4 shows another exemplary triple-mode microstrip filter 400, according to one embodiment. Filter 400 is similar to filter 300 (FIG. 3) discussed above, but stubs 416 and 418 extend from a different position on microstrip patch 404. In this example, stub 416 is approximately the same size as stub 316 (FIG. 3) and stub 418 is approximately the same size as stub 316. Slots 406, 408, 410 and 412, as well as feed lines 420 and 422 are substantially the same size and have the same positions as the corresponding components shown in FIG. 3. Additionally, shorting post 414 is in substantially the same position as shorting post 314 shown in FIG. 3.

Figure 5:
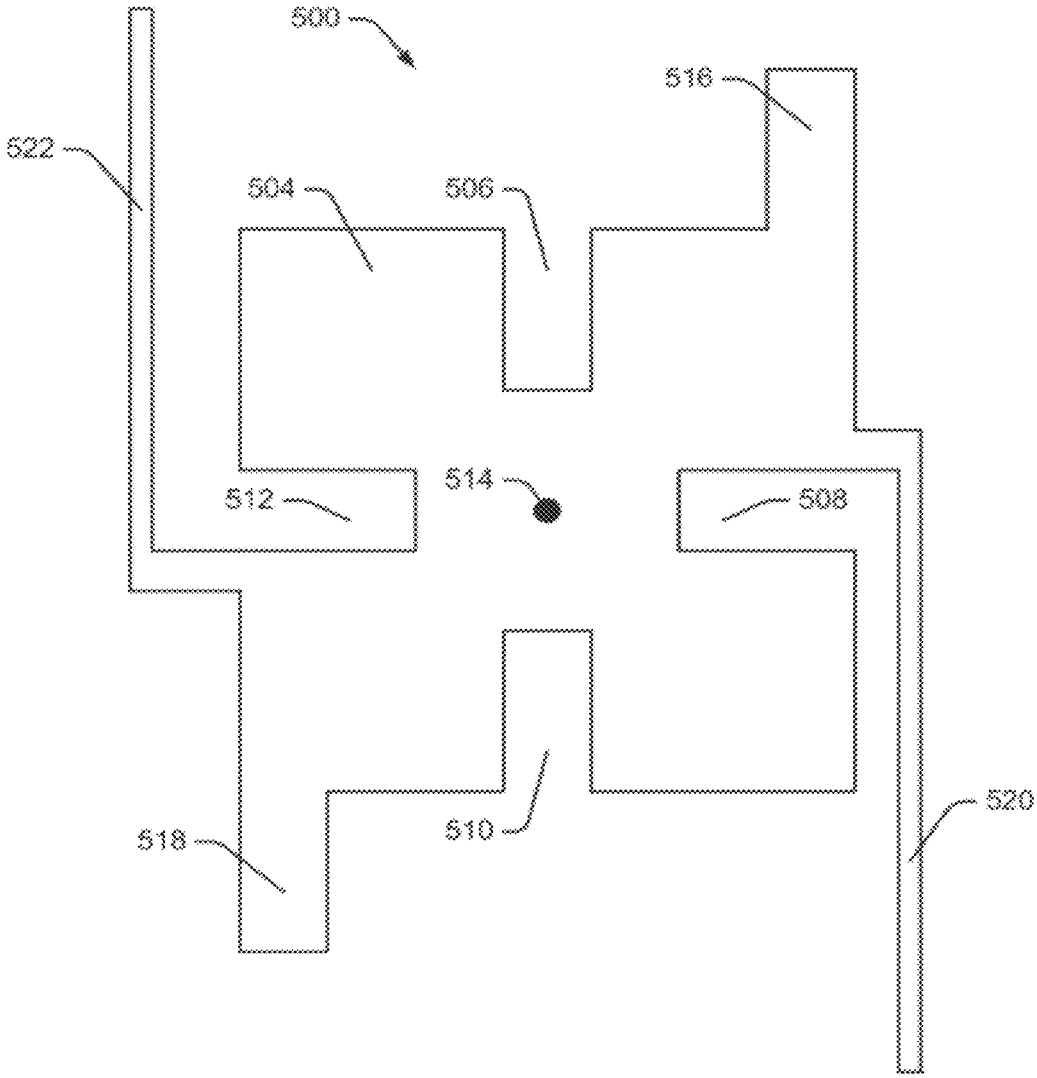
FIG. 5 shows another exemplary triple-mode microstrip filter, according to one embodiment.

FIG. 5 shows another exemplary triple-mode microstrip filter 500, according to one embodiment. The operational bandwidth of filter 500 is narrower than filter 100. Filter 500 is similar in shape to filter 300 (FIG. 3) discussed above, but feed lines 520 and 522 are significantly longer than feed lines 320 and 322. In this example, feed lines 520 and 522 are also referred to as "quarter wave lines." The length and width of feed lines 520 and 522 depends on the frequency of operation, the filter bandwidth, and the dielectric material properties. In this example, the dimensions of stubs 516 and 518, slots 506-512, feed lines 520 and 522 are interrelated and determined substantially by the required bandwidth of the filter. Additionally, shorting post 514 is in substantially the same position as shorting post 314 shown in FIG. 3. In a particular embodiment, the dimensions of feed lines 520 and 522 are calculated to match the filter with a 50 ohms RF termination. In this embodiment, the feeder is a quarter wave transformer at the filter center frequency. In alternate embodiments, the feeder is any device that provides a signal to the filter.

Figure 6:
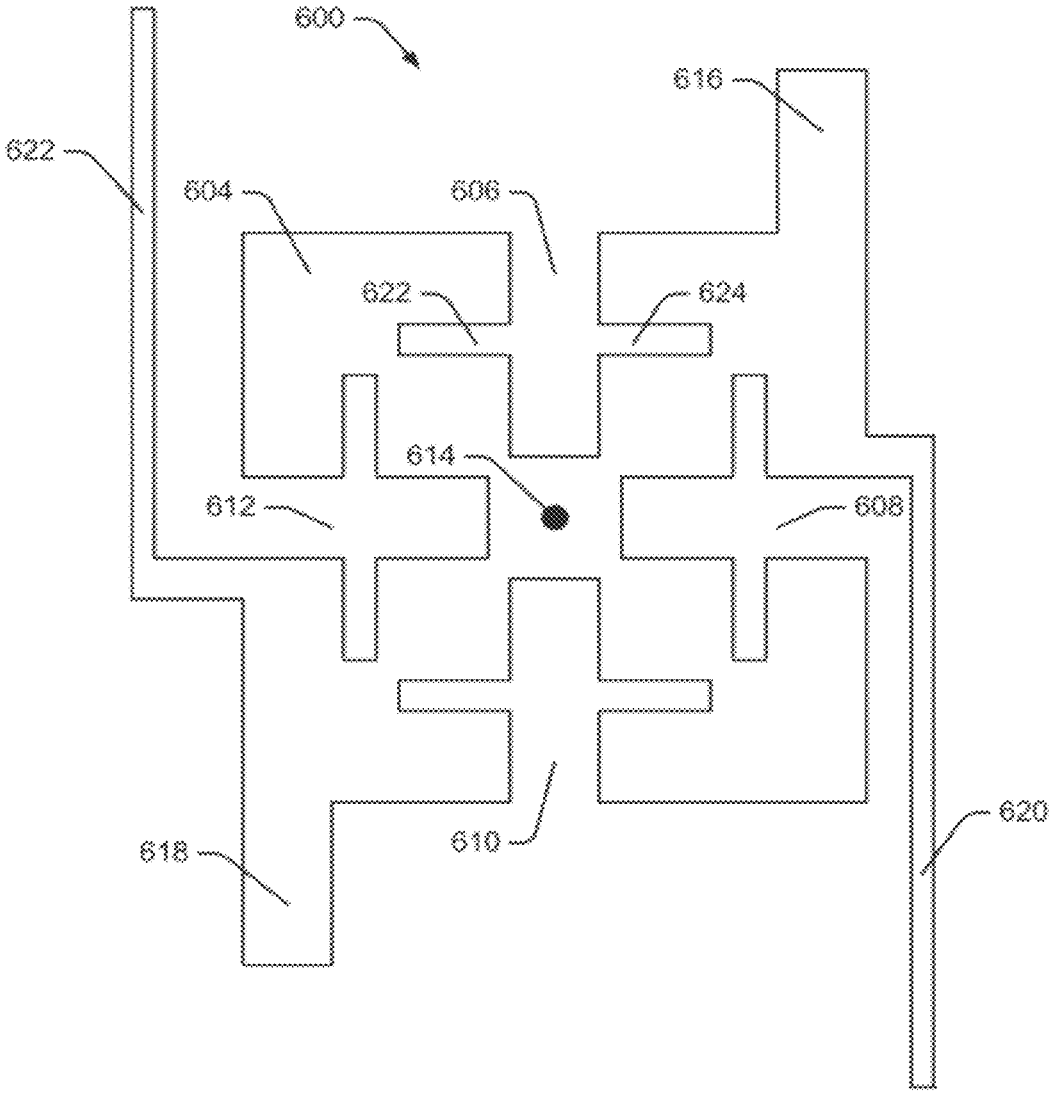
FIG. 6 shows another exemplary triple-mode microstrip filter, according to one embodiment.

FIG. 6 shows another exemplary triple-mode microstrip filter 600, according to one embodiment. Filter 600 includes feed lines 620 and 622, as well as stubs 616 and 618 that have substantially the same positions with respect to microstrip patch 604 as the corresponding components shown in FIG. 5. Slots 606, 608, 610 and 612 are similar to the corresponding slots shown in FIG. 5, but the slots extend farther into microstrip patch 604. Additionally, slots 606-612 have additional slot portions 622 and 624 extending perpendicularly in two directions from the larger portion of each slot. Shorting post 614 is in substantially the same position as shorting post 514 shown in FIG. 5. The eight slot portions 622 and 624 reduce the bandwidth of filter 600. The magnitude by which slot portions 622 and 624 reduce the filter's bandwidth is based on the length and width of the slot portions. In the example of FIG. 6, the filter center frequency decreases as the size of slot portions 622 and 624 increases. Calculation of an appropriate slot size is discussed below.

An Exemplary Procedure for Determining Filter Performance

Figure 7:
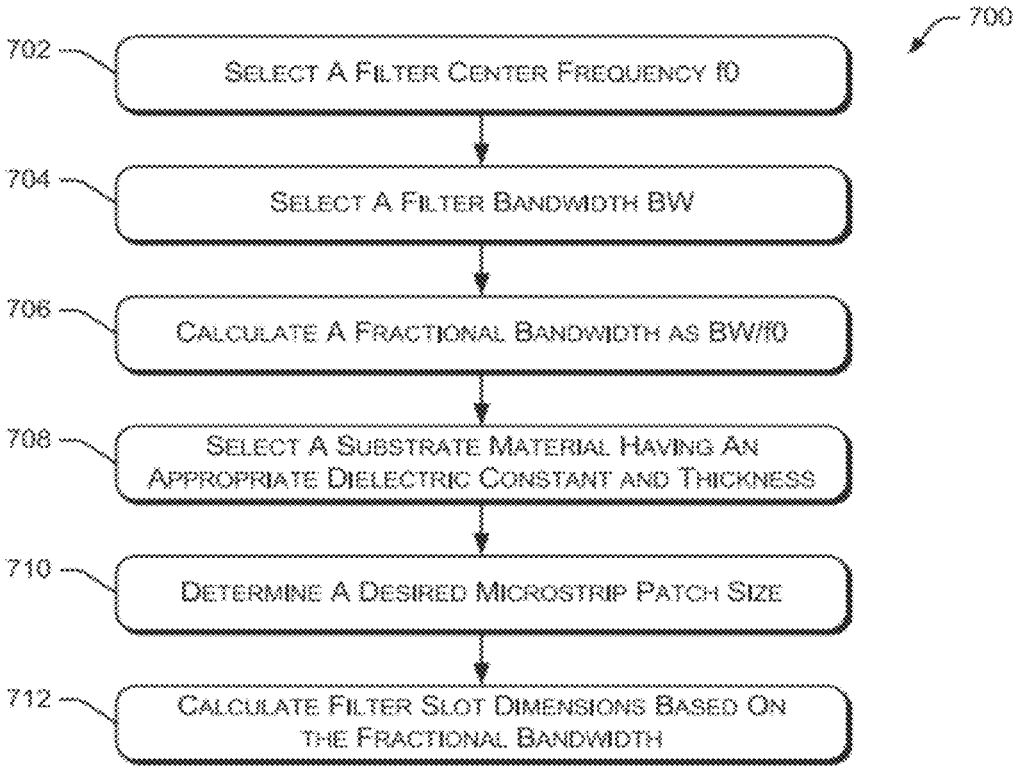
FIG. 7 is a flow diagram illustrating an example procedure for designing a triple-mode microstrip filter, according to one embodiment.

FIG. 7 is a flow diagram illustrating an example procedure 700 for designing a triple-mode microstrip filter, according to one embodiment. Initially, a user or designer selects a filter center frequency, f0 (block 702) and a filter bandwidth, BW (block 704). The procedure then calculates a fractional bandwidth (block 706), expressed as a percentage, as follows:

$$\text{Fractional bandwidth}=(BW/f0)*100$$

The user or designer then selects a substrate material having an appropriate dielectric constant, $\in_r$, and thickness h (block 708).

The procedure then determines a desired microstrip patch size (block 710). In a particular embodiment, the microstrip patch size is determined using the graph shown in FIG. 8 as discussed below. Finally, the procedure calculates filter slot dimensions based on the fractional bandwidth (block 710). In a particular embodiment, the filter slot dimensions are determined using the graphs shown in FIGS. 9 and 10, as discussed below.

Figure 8:
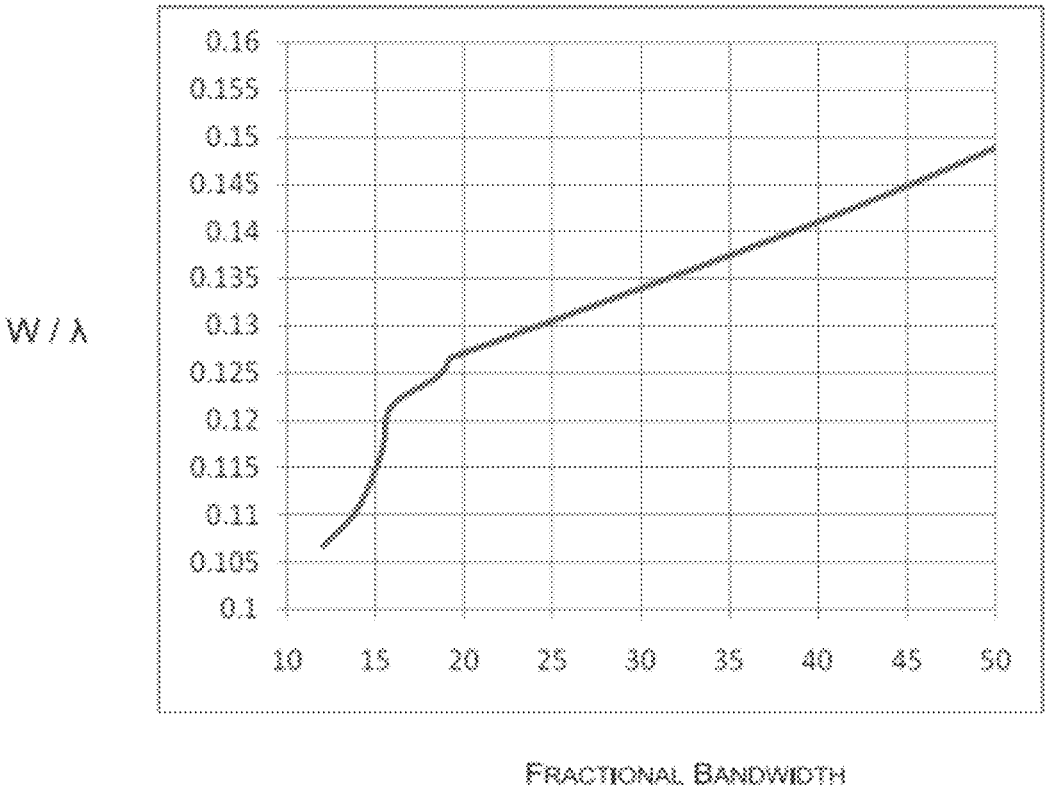
FIG. 8 shows an exemplary graph used in determining the appropriate width of the microstrip patch, according to one embodiment.

FIG. 8 shows an exemplary graph used in determining the appropriate width of the microstrip patch, according to one embodiment. As discussed above, the microstrip patch is substantially square. Thus, the "width" discussed below refers to the width of each side of the microstrip patch. The width of the microstrip patch is expressed in millimeters and identified in FIG. 8 with the variable "W". The width shown in FIG. 8 is based on the guided wavelength at the filter's center frequency, indicated as "W/λ". The value of λ is calculated as follows:

$$\lambda = \frac{300}{f_0\sqrt{\varepsilon_r}}\,\text{mm}(f0 \text{ in GHz})$$

where the value of λ is represented in millimeters and the value of f0 is represented in gigahertz. The fractional bandwidth is calculated as discussed above. After calculating the value of the fractional bandwidth, the curve shown in FIG. 8 is used to find the corresponding value of "W/λ". Since the value of λ is calculated using the above equation, the value of W can be determined. As mentioned above, this value of W represents the appropriate width of the microstrip patch to provide the desired operating characteristics.

Figure 9:
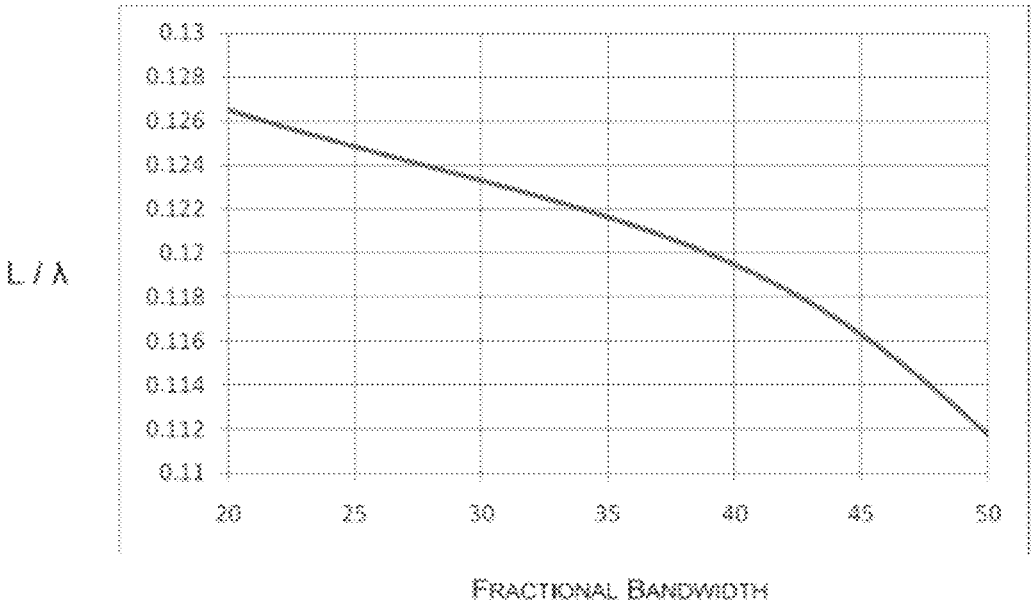
FIG. 9 shows an exemplary graph used in determining the appropriate slot length, according to one embodiment.

FIG. 9 shows an exemplary graph used in determining the appropriate slot length, according to one embodiment. As discussed above, embodiments of the microstrip patch include four slots extending inwardly from each side of the patch. The slot dimensions affect the operating characteristics of the microstrip filter. In particular implementations, the slot width ranges from 0.5 to 1.0 mm. Additionally, the slot length is generally greater than 1/20 of the waveguide wavelength associated with a particular substrate.

The curve shown in FIG. 9 is useful in calculating slot length for fractional bandwidths ranging from approximately 20% to 50%. The filter bandwidth (BW) is calculated as: BW=f3−f1. The filter center frequency (f0) is calculated as:

$$f0=(f1+f3)/2.$$

As discussed above, the Fractional bandwidth=(BW/f0)*100, expressed as a percentage. Using the value of λ calculated above, the fractional bandwidth, and the curve shown in FIG. 9, a value of L (slot length) is determined.

In a particular embodiment, filters are designed to pass frequencies between a lower frequency (f1) and an upper frequency (f3), and reject other frequencies. In this situation, the filter bandwidth is the difference between f1 and f3 (i.e., f3−f1). The center frequency (f0) is the mid-band frequency between f1 and f3, as calculated above. In this embodiment, the filter is a triple-mode resonator where f1 is the resonant frequency of the first mode and f3 is the resonant frequency of the third mode.

In embodiments having a fractional bandwidth greater than 20%, the filter structures shown in FIGS. 1, 3, 4 and 5 are appropriate. In these embodiments, the slot length is calculated as discussed above with respect to FIG. 9.

In embodiments having a fractional bandwidth less than 20%, the filter structure shown in FIG. 6 is appropriate. As discussed above, this filter structure includes increased slot sizes (with the additional slot portions 622 and 624), which reduce the filter bandwidth.

Figure 10:
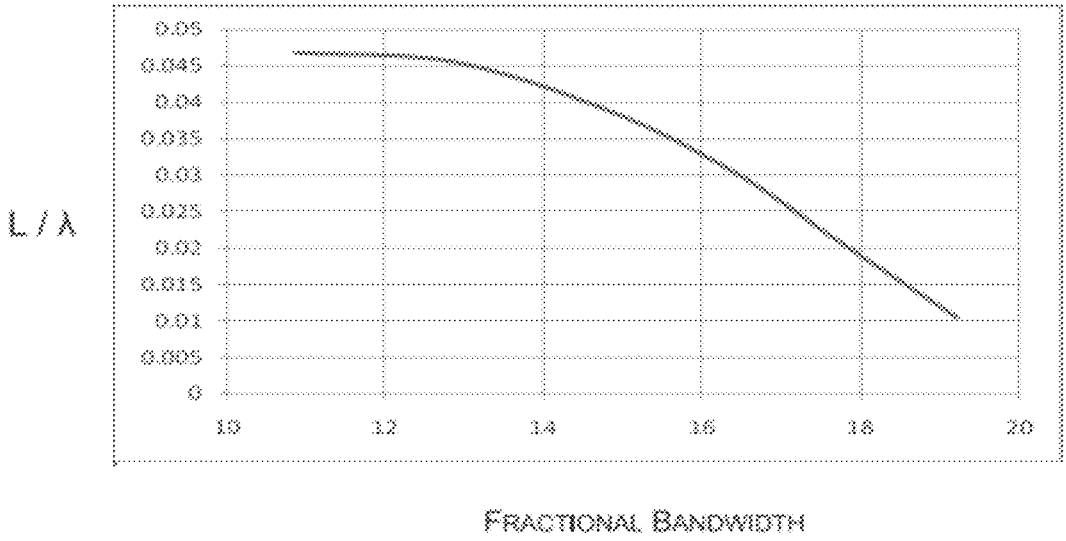
FIG. 10 shows another exemplary graph used in determining the appropriate slot length, according to one embodiment.

FIG. 10 shows another exemplary graph used in determining the appropriate slot length, according to one embodiment. The curve shown in FIG. 10 is used to determine the length of additional slot portions 622 and 624. The length of slots 606, 608, 610 and 612 are maintained at the maximum value shown in FIG. 9 (the value of approximately 0.126 of the waveguide wavelength).

The graphs shown in FIGS. 8, 9 and 10 are based on a Duroid substrate material having a dielectric constant of approximately 10.2 and a thickness of approximately 0.78. These graphs are also based on slots having a width of approximately 1.0 mm and a shorting post diameter of approximately 1.0 mm. In a particular embodiment, the graphs shown in FIGS. 8, 9 and 10 are calculated using an electromagnetic simulator, such as the IE3D design and simulation software available from Mentor Graphics Corp. of Wilsonville, Oreg.

Figure 11:
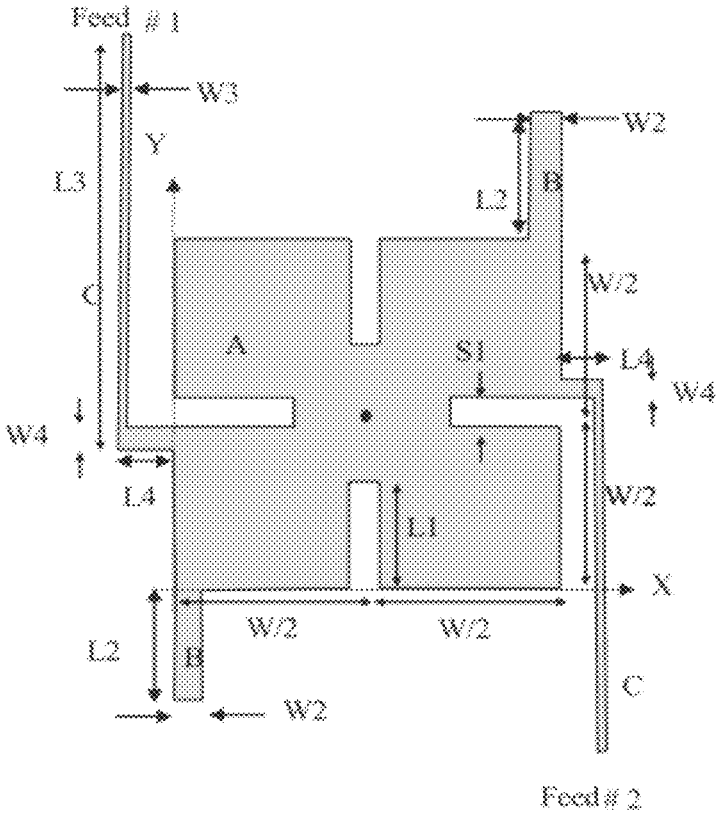
FIG. 11 shows aspects of an exemplary triple-mode microstrip filter, according to one embodiment.

FIG. 11 shows aspects of an exemplary triple-mode microstrip filter, according to one embodiment. In one implementation, a filter with the structure shown in FIG. 11 is designed and implemented on Duroid substrate with 10.2 dielectric constant and 0.635 mm thickness. In this example, feeds 1 and 2 are shown, and the patch size W=26 mm.

Exemplary dimensions of the filter of FIG. 11 are shown in Table 1. All dimensions are in mm.

TABLE 1

| | mm |
|---|---|
| L1 | 11.75 |
| S1 | 1 |
| L2 | 3 |
| W2 | 2 |
| L3 | 27 |
| W3 | 0.8 |
| L4 | 3 |
| W4 | 1 |

Figure 12:
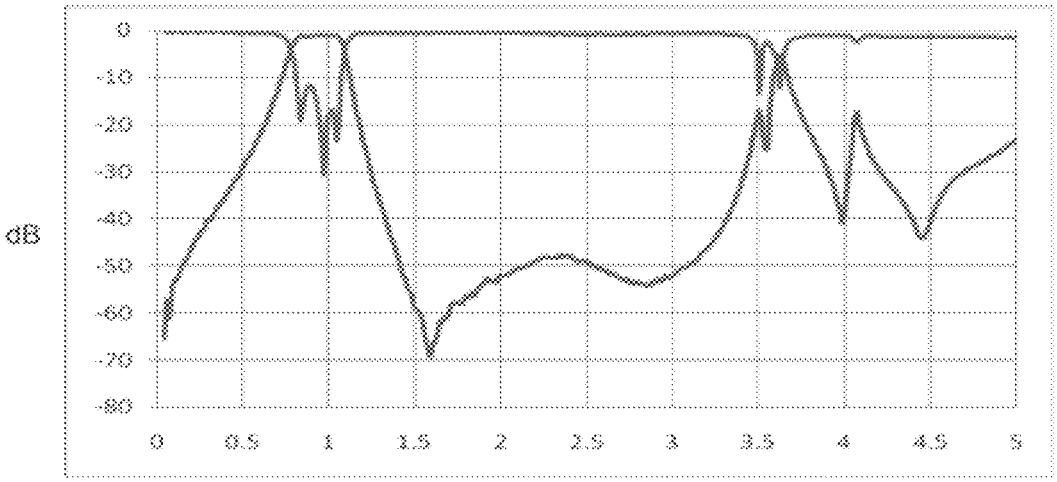
FIG. 12 shows an exemplary set of results of a synthesized filter with dimensions of the filter shown in FIG. 11, according to one embodiment.

FIG. 12 shows an exemplary set of results of a synthesized filter with dimensions of the filter of FIG. 11, according to one embodiment. In this example, filter performances were measured using Anritsu Vector Network Analyzer. As illustrated in FIG. 12, the 3-dB bandwidth of the filter is 300 MHz and centered at fc=0.94 GHz. The midband insertion loss is 0.8 dB. The out of band rejection is below 50 dB from 1.4 to 3.1 GHz. This means that the rejection of the second and third harmonics (around 2 fc and 3 fc) is more than 48 dB.

CONCLUSION

Although the microstrip filter systems and methods have been described in language specific to structural features and/or methodological operations or actions, it is understood that the implementations defined in the appended claims are not necessarily limited to the specific features or actions described. Rather, the specific filter features and operations are disclosed as exemplary forms of implementing the claimed subject matter.

The invention claimed is:

1. A filter structure comprising:

a substrate having a substantially planar surface; and a microstrip patch disposed on the surface of the substrate, the microstrip patch including:

a plurality of substantially symmetric slots in the microstrip patch;

a first feed line extending from the microstrip patch; and a second feed line extending from the microstrip patch, wherein the first and second feed lines are asymmetric;

wherein the first and second feed lines are located at opposite diagonal corners of the microstrip patch.

2. The filter structure as recited in claim 1 wherein an input signal is applied to the first feed line and an output signal is received from the second feed line.

3. A triple-mode filter comprising:

a substantially square microstrip patch having a plurality of substantially symmetric slots therein;

a plurality of stubs extending outwardly from the microstrip patch; and a conductive shorting post in electrical contact with the microstrip patch and a ground layer disposed on an opposite side of the substrate; and further comprising a plurality of asymmetric feed lines extending outwardly from the microstrip patch.

4. The triple-mode filter as recited in claim 3 wherein a respective one of the plurality of symmetric slots extends inwardly from each of the four sides of the microstrip patch.

5. The triple-mode filter as recited in claim 3 further comprising a first of the plurality of asymmetric feed lines extending outwardly from the microstrip patch and a second of the plurality of asymmetric feed lines extending outwardly from the microstrip patch.

6. The triple-mode filter as recited in claim 5 wherein an input signal is applied to the first feed line and an output signal is received from the second feed line.

* * * * *